United States Patent [19]

Casey

[11] Patent Number: 4,552,311

[45] Date of Patent: Nov. 12, 1985

[54] LOW COST UNITIZED FUEL INJECTION SYSTEM

[75] Inventor: Gary L. Casey, Troy, Mich.

[73] Assignee: Allied Corporation

[21] Appl. No.: 535,009

[22] Filed: Sep. 23, 1983

[51] Int. Cl.[4] ..... B05B 1/30

[52] U.S. Cl. ..... 239/585; 239/551

[58] Field of Search ..... 239/585, 584, 551; 251/139, 140, 141; 123/456, 470

[56] References Cited

U.S. PATENT DOCUMENTS

| | | | |
|---|---|---|---|
| 2,571,583 | 10/1951 | Kolbach | 239/551 X |
| 2,981,483 | 4/1961 | Pichon | 239/584 X |
| 3,490,701 | 1/1970 | Malec | 239/584 |
| 3,661,183 | 5/1972 | Komaroff et al. | 137/625.25 |
| 3,738,578 | 6/1973 | Farrel | 239/585 |
| 3,776,209 | 12/1973 | Wertheimer et al. . | |
| 3,827,409 | 8/1974 | O'Neill | 123/456 X |
| 4,030,668 | 6/1977 | Kiwior | 239/585 |
| 4,116,389 | 9/1978 | Furtah et al. | 239/585 |
| 4,218,021 | 8/1980 | Palma | 239/585 |
| 4,232,830 | 11/1980 | Casey et al. | 239/585 |
| 4,306,683 | 12/1981 | Mallinson | 239/585 |
| 4,354,640 | 10/1982 | Hans | 239/585 |
| 4,360,161 | 11/1982 | Claxton et al. | 239/463 |
| 4,385,339 | 5/1983 | Takada et al. | 239/585 X |
| 4,390,130 | 6/1983 | Linssen et al. | 239/585 |
| 4,454,990 | 6/1984 | Lewis | 251/141 X |

FOREIGN PATENT DOCUMENTS

| | | | |
|---|---|---|---|
| 1576463 | 5/1970 | Fed. Rep. of Germany . | |
| 3016993 | 11/1980 | Fed. Rep. of Germany . | |
| 1275719 | 5/1972 | United Kingdom | 239/585 |
| 2024937 | 1/1980 | United Kingdom . | |
| 2073316 | 10/1981 | United Kingdom . | |
| 2073954 | 10/1981 | United Kingdom . | |
| 2080415 | 2/1982 | United Kingdom . | |

*Primary Examiner*—Jeffrey V. Nase
*Assistant Examiner*—Daniel R. Edelbrock
*Attorney, Agent, or Firm*—James R. Ignatowski; Russel C. Wells

[57] ABSTRACT

A unitized fuel injection system having a common fuel rail, a fuel pressure regulator permanently attached to one end of the fuel rail and a plurality of fuel injector valves having progressive die formed housings permanently attached to the fuel rail. Each fuel injector valve embodies a light weight movable valve member electromechanically actuated by a solenoid coil assembly, a stationary valve member having a conical valve seat and a metering plate having a metering orifice. The movable valve member has an armature and a valve stem having a spherical end surface mating with the conical valve seat. The displacement of the movable valve member is sufficient to allow the fuel flow to be controlled by the size of the metering orifice and virtually independent of the position of the valve stem. Design of the fuel injector valve is directed to minimize machining operations of the valve's component parts to reduce costs.

31 Claims, 11 Drawing Figures

LOW COST UNITIZED FUEL INJECTION SYSTEM

BACKGROUND OF THE INVENTION

The invention is related to fuel injection systems for internal combustion engines and in particular to a low cost fuel injection system having a plurality of electrically activated fuel injector valves attached to a common fuel rail.

PRIOR ART

Fuel injector systems having a plurality of electrically actuated fuel injector valves receiving fuel from a common fuel rail are known in the art. In these systems, fuel under pressure from a fuel pump is distributed to the individual fuel injector valves by means of a common fuel rail. A pressure regulator connected to one end of the fuel rail regulates the fuel pressure in the fuel rail as well as in the individual fuel injector valves. Normally the fuel rail, pressure regulator, and the fuel injection valves are individual components which are connected upon assembly to the engine. These connections require a plurality of fluid tight fittings and resilient seals, all of which are subject to leaking over the life of the vehicle. Further, upon replacement of any failed component, the component or the system must be recalibrated to assure optimal operation of the system. Additionally, most of the current fuel injector valves require many precision machined parts which make them relatively expensive and difficult to manufacture.

The unitized fuel injection system described herein is designed to eliminate all mechanical fluid connections between the fuel rail, the fluid pressure regulator and the fuel injector valves to reduce the number of resilient seals to two per fuel injector valve, and eliminate most of the expensive machining associate with the manufacture of the fuel injector valve. The result is a low cost unitized fuel injection system wherein the fuel rail, pressure regulator and the housing for each fuel injector valve are manufactured as an integral assembly requiring only two fluid connections upon assembly to the engine, the input from the fuel pump and the return line from the fuel pressure regulator. The low cost design of the fuel injector valve makes it economical to replace the entire unitized fuel injection system upon the failure of any subcomponent. Because the fuel injection system is an integral assembly, it can be factory calibrated eliminating the need for recalibration and problems associated with contemporary fuel injection systems.

SUMMARY OF THE INVENTION

The invention is a low cost unitized fuel injection system having a fuel rail, a pressure regulator connected to one end of the fuel rail and a plurality of fuel injector valves connected to the fuel rail at predetermined positions therealong. Each fuel injector valve comprising a generally cylindrical valve housing, a metering plate having a metering orifice and a stationary valve member disposed at one end of the valve housing, an end cap enclosing the other end of the valve housing, a movable valve member having a valve stem attached to an axially movable armature, a coaxial stator attached to the end cap and axially separated a predetermined distance from the armature, a resilient member disposed between the stator and armature producing a force urging the valve stem against the valve seat, and a coil assembly circumscribing the armature and stator for producing a magnetic force axially displacing the armature towards the stator against the force of the resilient member. The low cost unitized fuel injection system is characterized in that said valve housings are tangentially attached to said fuel rail and becoming an integral part thereof, each of the valve housings having a fuel input port interfacing with a mating port in the fuel rail at the point of tangential attachment, the stationary valve members having a conical valve seat, the valve stem of each movable valve member having a spherical end surface engaging said valve seat, the stator axially separated from said armature a distance sufficient so that when the valve stem is fully retracted from the valve seat by the coil assembly, the fuel flow is dependent primarily upon the diameter of the metering orifice and substantially independent of the position of the valve stem, and wherein the coil assembly includes a fluid vent connecting the volume enclosed between the armature, stator and coil assembly with the remainder of the volume enclosed by the housing permitting a fuel flow therebetween with the opening and closing of the movable valve member.

The advantage of the unitized fuel injection system is that the fuel rail, fuel injector valves, and fuel pressure regulator are an integral assembly significantly reducing the number of fittings and resilient seals and minimizing the number of potential sources of fuel leaks.

Another advantage of the unitized fuel injection system is the ability to build a matched set of fuel injector valves and fuel pressure regulator without worrying about interchangeability of components.

Another advantage of the initized fuel injector system is the use of non-adjustable return springs eliminating the adjustment tube and associated resilient seals of contemporary fuel injector valves.

Still another advantage of the unitized fuel injector system is the low reciprocating mass of the movable valve member making the opening and closing times of the injector valve proportionately shorter.

Yet another advantage provided by the system is the use of a larger than normal rectraction distance of the vlave stem from the valve seat so that the fuel flow is determined primarily by the diameter of the metering orifice and is substantially, independent of the position of the valve stem.

Another advantage of the system is the fluid vent through the coil assembly which prevents the build up of fluid pressure in the space enclosed by the armature, stator and coil assembly further reducing the opening and closing times of the valve.

A final advantage is that the design of the injector valve is directed towards using simple manufacturing processes for its subcomponent elements which substantially reduce the costs of the fuel injection system.

These and other advtanges will become more apparent from a reading of the detailed description of the invention in connection with the drawings.

DETAILED DESCRIPTION OF THE INVENTION

Figure 2:
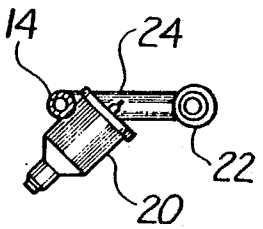
FIG. 2 is a cross sectional view of a portion of the unitized fuel injection system showing the input port.
Figure 1:
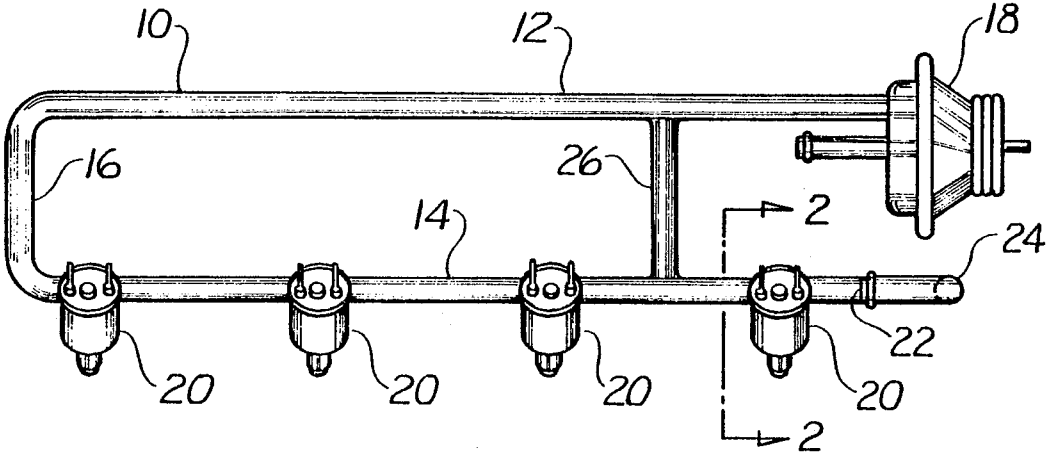
FIG. 1 is a perspective of the unitized fuel injection system.

The unitized fuel injection system shown on FIG. 1 comprises a integral tubular fuel rail 10, a pressure regulator 18 permanently attached to one end of the tubular rail 10, a plurality of fuel injecor valves 20 connected to fuel rail 10 at predetermined locations, and a fuel input port 22 at the other end of the fuel rail 10 adapted to receive fuel under pressure from a fuel pump (not shown) in a conventional manner. The fuel rail 10 may be formed in a "U" shape, as shown, having a pair of legs 12 and 14 interconnected at one end by a base portion 16. The end of leg 14 containing fuel input port 22 may be folded back to form a "U" shaped segment 24, as more clearly shown in FIG. 2, making the fuel input port 22 more accessible for connection to the fuel pump. A cross bar member 26, structurally ties together the otherwise unsupported ends of legs 12 and 14 adjacent to the pressure regulator 18 and fuel input port 22. The fuel rail 10 is preferably a single piece of stainless steel tubing bent to the configuration shown but other metals may be used. The housings of the fuel injector valves 20 are tangentially welded or brazed to the fuel rail 10 at locations predetermined by the location of the intake ports of the associated engine (not shown) and form an integral part of the fuel rail. Mating apertures in the housings of each fuel injector valve and fuel rail 10 at the tangential connection therebetween provide for fuel delivery to the injector valves 20 as more clearly shown in FIG. 5.

In the preferred embodiment, the pressure regulator 18 and the housings of the fuel injector valves 20 are welded or brazed to the fuel rail 10 making it a unitized assembly. The tangential connection of the fuel injector valve housings to the fuel rail 10 permits the fuel rail 10 to be a single length of tubing. Another advantage of the tangential connection between the fuel rail 10 and the injector valves 20 is that any gas or vapor bubbles formed in one valve will not be communicated to any of the downstream valves. Any vapor bubbles formed will rise to the top of the fuel rail 10 and be transmitted in the fuel rail past the remaining downstream fuel injector valves directly to the pressure regulator 18. In many of the current fuel injector systems, the fuel is transmitted through each and every injector valve so that the bubbles formed in the upstream valves can potentially collect in one of the downstream valves adversely affecting its operation.

PRESSURE REGULATOR

Figure 3:
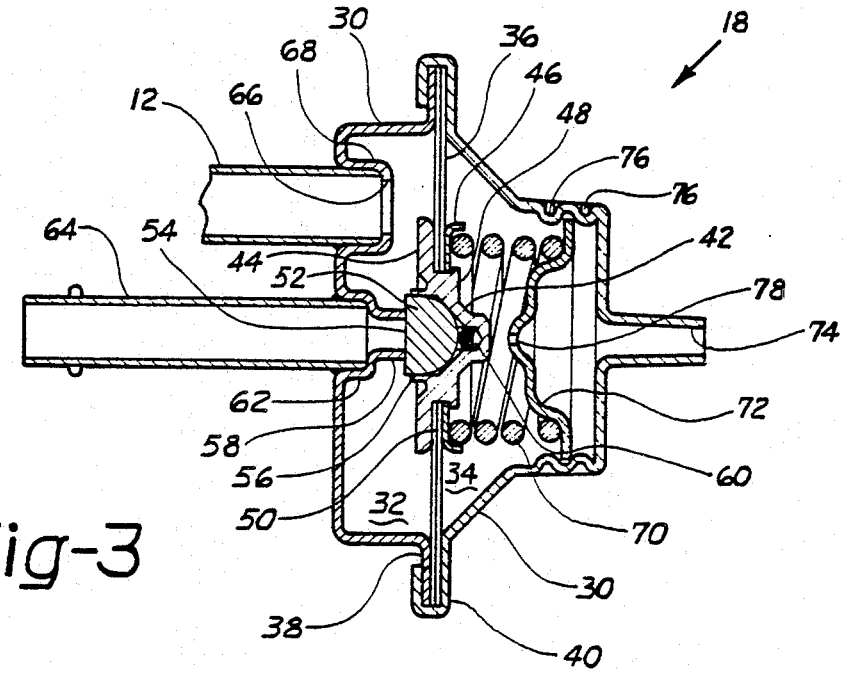
FIG. 3 is a cross sectional view of the fuel pressure regulator.

The details of the fuel pressure regulator 18 are shown on FIG. 3. Referring to FIG. 3, the fuel pressure regulator 18 comprises a two-piece housing 30 enclosing a pair of valve chambers 32 and 34 separated by a flexible diaphragm 36. The diaphragm 36 is clamped abouts its periphery between mating flanges 38 and 40 of the two-piece housing 30 as shown: A displaceable valve assembly 42 is fixedly clamped to the central portion of the flexible diaphragm 36 between a valve support member 44 and a spring seat 46 as shown. A lip 48 of the valve support member 44 is crimped over clamping the flexible diaphragm between a mating surface 50 of the valve support member 48 and the spring seat 46. A floating spherical valve member 52 having a flat valve seat contact surface 54 is disposed in an appropriate recess in valve support member 44. A lip 56 of valve support member 44 is swaged over to retain the floating spherical valve member 52 within the provided recess with the flat contact surface adjacent to a valve seat 58. A spring 60 disposed at the bottom of the recess provided in valve support member 44 produces a force urging spherical valve member 52 against lip 56.

Valve seat 58 is a cylindrical boss formed integral with and projecting into valve chamber 32. The internal end of valve seat 58 abuts the flat surface 54 of valve member 52. Valve seat 58 further has an enlarged portion 62 adjacent to housing 30. A fuel return conduit 64 adapted to be connected to the vehicle's fuel tank (not shown) is welded or brazed in the enlarged portion 62 of the valve seat 58 as shown. An inlet aperture 66 is formed at the end of a generally cylindrical inlet boss 68, radially offset from valve seat 58. The end of leg 12 of the fuel rail 10 is welded or brazed in boss 68 permantly attaching the pressure regulator 18 to one end of fuel rail 10.

A spring 70 disposed between the spring seat 46 and a pressure plate 72 urges the displaceable valve assembly 42 towards the valve seat 58 with a force sufficient to hold the flat surface 54 of spherical valve member 52 against the end of valve seat 58 when the fuel pressure in fuel rail 10 is below a predetermined value. When the pressure in the fuel rail exceeds the predetermined pressure, the force exerted on the flexible diaphragm 36 and displaceable valve assembly 42 by the higher fuel pressure will move the displaceable valve assembly 42 against the force exerted by spring 70 and unseat the flat surface 54 of spherical valve member 52 from the valve seat 58. The unseating of the flat surface 54 from the valve seat 58 will allow fuel to flow through the return conduit 64 back to the fuel tank thereby reducing the pressure being applied to the flexible diaphram 36 and valve assembly 42. By this action the fuel pressure in fuel rail 10 is regulated to the pressure predetermined by spring 70.

In assembly, a predetermined force is applied to the pressure plate 72 through an atmospheric pressure vent 74 at the right hand portion of housing 30 as viewed in FIG. 3. The neck of housing 30 circumscribing pressure plate 72 is dimpled as indicated by dimples 76 locking the periphery of the pressure plate 72 in a position so that spring 70 exerts the required force on the displaceable valve assembly 42. The pressure plate 72 has at least one bleed vent 78 therethrough so that the side of the flexible diaphragm 36 opposite inlet aperture 66 is always exposed to atmospheric air pressure independent of any displacement of the flexible diaphragm 36 and valve assembly 42 relative to pressure plate 72.

FUEL INJECTOR VALVE

Figure 4:
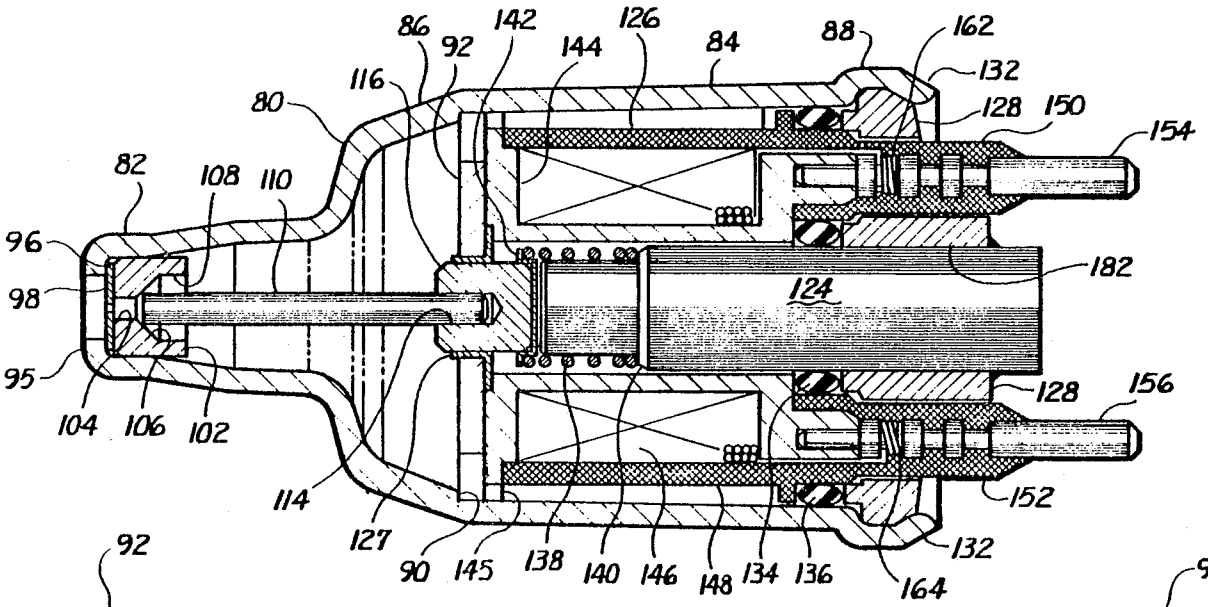
FIG. 4 is a first cross sectional view of the fuel injector valve.

The details of the fuel injector valve 20 will be discussed relative to FIGS. 4 through 9. Referring first to FIG. 4 the fuel injector valve 20 comprises a generally cylindrical housing 80 permanently attached to the fuel rail 10. The housing 80 has a necked down forward section 82, a central body section 84, a contoured intermediate section 86 interconnecting the forward section 82 and the body section 84, and a slightly enlarged cap section 88. The housing is made from magnetically permeable low carbon steel such as SAE or ASTM 1005 on a progressive die.

Figure 7:
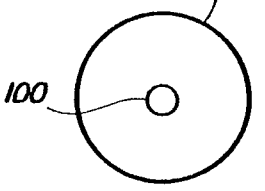
FIG. 7 is a plan view of the metering plate.
Figure 8:
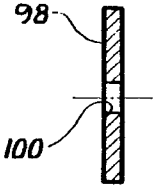
FIG. 8 is a cross sectional side view of the metering plate.
Figure 6:
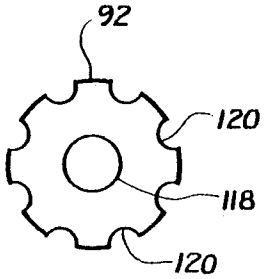
FIG. 6 is a plan view of the flux plate.
Figure 5:
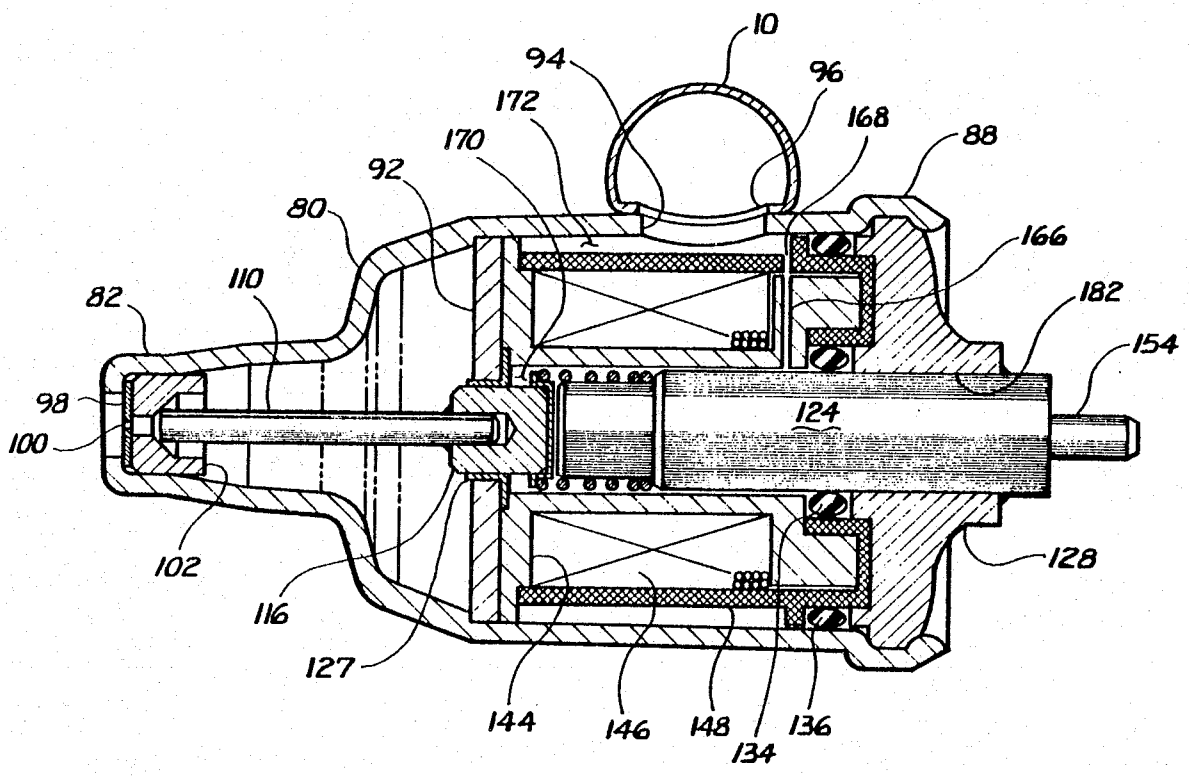
FIG. 5 is a second cross sectional view of the fuel injector valve rotated 90° relative to the position shown in FIG. 4.

A seat 90 for a flux plate 92 is formed at the junction between the body section 84 and the intermediate section 86. Seat 90 may be machined in housing 80 as shown in FIG. 3 or may be formed by a series of radial dimples as explained with reference to FIG. 11. The body section also includes a single fuel inlet aperture 94 mating with a corresponding aperture 96 in the fuel rail 10 as shown in FIG. 5. Inlet aperture 94 is a fuel entrance port receiving fuel under pressure from fuel rail 10. The cylindrical housing 80 is welded or brazed to fuel rail 10 about the periphery of inlet aperture 94 integrally attaching housing 80 to fuel rail 10 and providing a fluid tight seal therebetween. The end face of the forward section 82 is partially enclosed by an annular end face 95 internally defining a metering plate seat 96 for a metering plate 98. The metering plate 98 is a stamped disc 0.05 to 0.125 millimeter (0.002 to 0.005 inches) thick, made from 302 stainless steel and has a central disposed metering orifice 100 as shown in FIGS. 7 and 8.

Figure 9:
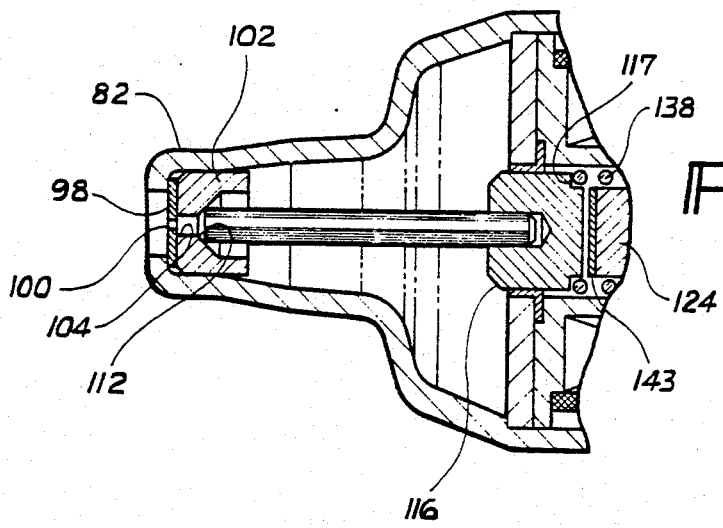
FIG. 9 is a partial cross section of the forward section of the fuel injector valve.

The metering plate 98 is held in place between the annular end face 95 and a stationary valve member 102 pressed into the necked down forward section 82 of housing 80. The valve member 102 has an axial aperture 104 mating with metering orifice 100. Axial aperture 104 is larger than the metering orifice 100 and for example may have a diameter of approximately 1 millimeter (0.040 inches). A conical valve seat 106 at the bottom of a recess 108 provided in the opposite surface of stationary valve member 102 intercepts aperture 104. The recess 108 is larger than aperture 104 and receives one end of a valve stem. Referring to FIG. 9, the valve stem 110 is made from a 440 C stainless steel rod having an end surface 112 abutting with the conical valve seat 106 of the stationary valve member 102. Preferably end surface 112 is a spherical surface or a segment of a shpere. In a typical example, valve stem 110 has a diameter of 1.5 millimeters 0.060 inches). The spherical surface has a 1.8 mm (0.072) radius. The end of the valve stem 110 is hardened to prevent deformation and reduce wear. The opposite end of valve stem 110 is welded into a centrally disposed bore 114 in armature 116 as shown on FIGS. 4 and 5. Referring back to FIG. 4 the armature 116 is made from magentically permeable 430 FR stainless steel and received in the central aperture 118 of flux plate 92. The flux plate 92, shown in detail in FIG. 6 has a central aperture 118 passing therethrough and plurality of half circle cutouts 120 about its periphery permitting fuel to flow from the body section 84 of the housing 80 to the forward section 82. A stainless steel non-magnetic steel eyelet 127 fitted into aperture 118 of the flux plate 92 provides a smooth wear resistant bearing surface for armature 116 about the periphery of aperture 118.

The body section 84 of the housing 80 encloses a magnetically permeable stator 124 made from 430 FR stainless steel circumscribed by a coil assembly 126. The stator 124 is welded or brazed to a sintered iron or cold formed low carbon steel end cap 128 received in the enlarged section 88 of body 80. The end cap 128 abuts the rear end of coil assembly 126 as shown in FIG. 5. The rear edge 132 of the cap section 88 is rolled over, locking the end cap 128 and coil assembly 126 against flux plate 92. A pair of resilient seals such as "O" rings 134 and 136 provide peripheral fluid seals between the housing 80, coil assembly 126, and stator 124. In particular "O" ring 134 provides for a fluid tight seal between the stator 124 and the coil assembly 126 while "O" ring 136 provides a fluid tight seal between the coil assembly 126 and housing 80. "O" rings 134 and 136 are the only two resilient seals used in the fuel injector assembly as compared to 4 or more used in conventional fuel injector assemblies.

The armature 116 is resiliently biased towards the forward end of the injector valve by a return spring 138 disposed between a shoulder 140 formed integral with stator 124 and a non-magnetic spring seat 142 abutting the surface of the armature 116 opposite stem 110. The spring seat 142 is a cup shaped member received over the end of armature 116 and has a peripheral flange engaged by the return spring 138. The biasing force of return spring 138 seats the spherical end of the valve stem 110 against the conical valve seat 106 of the stationary valve member 102.

The spring seat 142 serves two separate purposes in fuel injector valve 20. As previously described it serves as a seat for return spring 138 transmitting the force generated by return spring 138 to armature 116 and valve stem 110. It also functions as a non-magnetic spacer between armature 116 and stator 124. As is known in the art, the non-magnetic spacer between the armature 116 and stator 124 inhibits the residual magnetic fields in the armature 116 and stator 124 from delaying the return of the armature to its forward position by return spring 138 after the electrical signal to the coil assembly 126 is terminated. The non-magnetic spacer reduces the closing time of the fuel injector valve and makes the closing time more consistent.

In the preferred embodiment, the spacing between the spring seat 142 in its forward position and the stator 124 is approximately 0.20 mm (0.008 inches) permitting the stem valve to be displaced a like distance when the armature 116 is displaced towards the stator 124 under the influence of the magnetic field generated by the coil assembly 126. This distance is sufficient to displace the stem valve 110 far enough away from the conical valve seat 106 of the stationary valve member 102 so that the retracted valve stem 110 has very little effect on the rate at which fuel is ejected from the valve through metering orifice 100. Because the position of valve stem 110 has little effect on the rate at which fuel is ejected, minor differences in the spacing between the armature 116 and stator 124 or in the thickness of spring seat 142 will not change the fuel injection rate of the valve. The fuel injection rate is dependent almost entirely upon the diameter of the metering orifice 100 of metering plate 98 and the fuel pressure and is substantially independent of the position of the retraced valve stem.

The response time of the fuel injector valve 20 is preserved by making the armature 116 and valve stem 110 as small as possible to reduce their inertial mass to a minimum. In the preferred embodiment, the diameter of the armature is approximately 5 mm (0.20 inches) and its length is approximately 4.5 mm (0.18 inches). The diameter of the valve stem 110 is approximately 1.50 mm (0.060 inches) and its length is approximately 19 mm (0.76 inches). The assembly comprising the stem valve 110 and armature 116 weighs approximately 0.8 grams.

Tests have shown that the response time of the fuel injector valve 20 embodying an armature and valve stem as described above is significantly faster than the response time of commerically available fuel injector valves.

One feature of the fuel injector valve 20 is the use of a non-adjustable return spring 138 eliminating the adjusting tube and resilient seals of contemporary fuel injector valves. At assembly, the return spring 138 and stator 124 are preselected to produce the desired force urging the valve stem 110 against valve seat 106. Prior to assembly each return spring 138 is measured to determine the compressed height at which it produces the desired force. The return spring is then mated with a stator 124 having its spring seat 140 machined at a location corresponding to the measured compressed height. This procedure eliminates the need for subsequent calibration of the individual fuel injector valves after assembly. As previously indicated the unitized fuel injection system is calibrated as a whole and no further adjustments are required upon assembly to the engine.

The coil assembly 126 comprises a molded plastic bobbin 144 circumscribing the stator 124, a solenoid coil 146 comprising approximately 300 turn of 27 gage wire and a plastic bobbin cover 148 molded over bobbin 144 enclosing solenoid coil 146. The bobbin 144 has a plurality of peripheral spacer tabs 145 which mate with the inner surface of housing 80 and concentrically align the bobbin 144 with the housing. The bobbin cover 148 has two dimetrically disposed rearwardly protruding cylindrical extensions 150 and 152 in which are molded electrical terminals 154 and 156, respectively. The rear ends of the electrical terminals 154 and 156 protrude external to the ends of the cylindrical extentions 150 and 152 and are adapted to be connected to an electronic fuel control computer (not shown). The opposite ends of the electrical terminals 154 and 156 protrude internal to bobbin cover 148 and are received in a pair of mating bores 158 and 160 formed in bobbin 144. The opposite ends of the windings of solenoid coil 146 are electrically connected to internal ends of electrical terminals 154 and 156. The electrical connections are made by winding the ends of the winding of solenoid coil 146 around electrical terminals 154 and 156 as shown at 162 and 164. The ends of the windings are then soldered or welded to the electrical terminals assuring good electrical connection.

Additionally, the bobbin 144 includes at least one fluid relief vent 166 as shown in FIG. 5. The bobbin cover 148 has a mating fluid relief vent 168. The fluid relief vents 166 and 168 form a fluid passage connecting the inner chamber 170 formed between bobbin 144, stator 124 and armature 116 with an outer chamber 172 between the bobbin cover 148 and housing 80. The outer chamber 172 includes the fuel inlet aperture 94 connected to the fuel rail 10 through mating aperture 96. The function of the fluid passage formed by relief vents 166 and 168 is to permit fuel and vapor to easily flow in and out of the inner chamber 170 as its volume changes with reciprocation of armature 116.

The armature 116, stator 124, end cap 128 body 80 and flux plate 92 form a continuous low reluctance flux path for magnetic field generated by the solenoid coil 146.

OPERATION

The fuel injector valve receives fuel from the fuel rail 10 through mating apertures 94 and 96 in the fuel rail 10 and the body portion 84 of the valves housing 80. In its static state with the solenoid coil 146 unenergized, the spherical end of valve stem 110 is held against the conical valve seat 106 of the stationary valve member 102 occluding aperture 104 due to the force exerted by return spring 138 on spring seat 142 and armature 116. Energizing solenoid 146 generates a magnetic field across the spacing between armature 116 and stator 124 which produces a magnetic force retracting the armature 116 towards the stator 124 against the force of return spring 138. The retraction of armature 116 unseats valve stem 110 from the conical valve seat 106 of valve member 102 permitting fuel to flow through aperture 104 of the valve member 102 and metering orifice 100 of metering plate 98. The fuel exiting from the metering orifice produces a conical spray pattern having an included spray angle ranging from 15° to 25° as a function of the fuel pressure determined by fuel pressure regulator 18. As previously described, the valve stem 110 is retracted from the conical valve seat 106 a distance sufficient so that the fuel flow rate through metering aperture 100 is dependent primarily on the diameter of the metering orifice 100 and the fuel pressure determined by pressure regulator 18 and is substantially independent of the position of valve stem 110. Since the pressure drop across the valve, between the retracted valve stem 110 and valve seat 106, is small, the valve stem has little effect on the fuel flow rate and spray pattern. Therefore, there is no requirement for mechanically supporting the unseated valve stem 110 in alignment with aperture 104 even when the valve stem assumes a position against the side wall of the valve seat 106.

Retraction of armature 116 towards stator 124 displaces the fuel previously occupying the free space therebetween. This displaced fuel and any vapor bubbles flow in the space between the armature 124 and bobbin 144 exiting the inner chamber 170 via relief vents 166 and 168. This venting of the displaced fuel and entrapped vapor bubbles prevents a fuel pressure build up between armature 116 and stator 124 which would have otherwise retarded or changed the rate of the retraction of armature 116.

Deenergizing the solenoid coil 146 terminates the magnetic field producing the magnetic force holding the armature 116 in its retracted position. The armature 116 will now move forward due to the force generated by return spring 138 and the valve stem 110 will seat on the conical valve seat 106 of the valve member 102 occluding aperture 104. Occluding of aperture 104 will terminate the fuel flow through metering orifice 100. As previously indicated, the spring seat 142 serves as a non-magnetic spacer between the armature 116 and stator 124 preventing residual magnetism of either of armature or stator or both from delaying the return of the armature to its static position by return spring 138. With the return of the armature to its static position, the volume of chamber 138 increases due to the separation of armature 116 from stator 124. Fluid at fuel rail pressure will now flow from the outer chamber 172 to inner chamber 170 through relief vents 166 and 168 filling the void between armature 116 and stator 124. Effectively, relief vents 166 and 168 equalize the fuel pressure on the opposite sides of armature 116 reducing the force required to move it from one position to the other. As a result of these two factors the valve 20 will close quickly and consistently with the termination of the signal energizing solenoid coil 146.

ALTERNATE EMBODIMENTS

Figure 10:
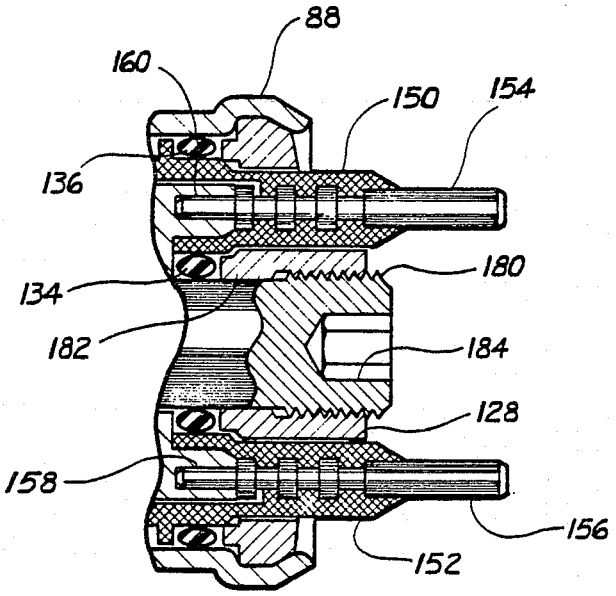
FIG. 10 is a partial cross section of a first alternate embodiment of the fuel injector valve.

In contrast to the configuration shown in FIGS. 4 and 5, the stator 24 may be threadably received in the end cap 128. Referring to FIG. 10 the rear position 180 of the stator 124 is threaded. Correspondingly, a portion of the aperture 182 in the end cap 128 through which stator 124 is inserted is also threaded. A hexagonally shaped recess 184 is provided at the rear end of stator 124, to receive a hexagonally shaped wrench, such as an Allen wrench, to facilitate turning stator 124. In assembly, the stator 124 is threaded into the end cap 128 until its forward end seats against spring seat 172 and amrature 116. The stator 124 is then rotated in the reverse direction through an angular increment predetermined to provide the desired 0.25 mm spacing between the stator 124 and spring seat 172. The threaded portion 180 of the stator is then either staked in position or welded in place to prevent further rotation between the stator 124 and end cap 128.

Figure 11:
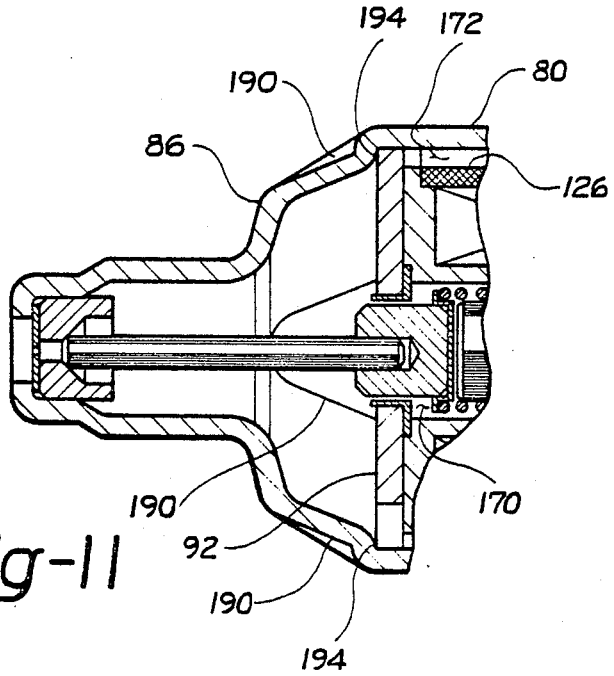
FIG. 11 is a partial cross section of a second alternate embodiment of the fuel injector valve.

The single machining step of housing 80 to form the flux plate seat 90 may be eliminated by modifying the housing as shown in FIG. 11. Referring to FIG. 11, the intermediate section 86 of housing 80 may be modified by forming a plurality of equally spaced dimples 190 about the periphery of the intermediate section 86. The dimples 190 are shaped to form a like plurality of flux plate seats 194 equally spaced about the interior of housing 80 defining a plane normal to the axis of housing 80. Preferably 3 or 4 dimples 190 are formed in housing 80 to provide an ample space between the dimples for fluid flowing through the cutouts 120 in the flux plate 92 to pass from the outer chamber 172 formed between housing 80 and coil assembly 126 into the forward end of the housing. By forming the dimples 190 during the progressive die forming of the housing 80, substantially all machining of the housing is eliminated.

Referring back to FIG. 9, there is also shown an alternate embodiment of the armature 116. In this embodiment the spring seat 142 is eliminated and the seat for spring 138 is a peripheral shoulder 117 provided at the rear end of the armature 116. A non-magnetic spacer 143 is attached to the end of stator 124 facing armature 116 to compensate for the elimination of the spring seat 142.

The valve is designed to reduce the number of parts requiring precision manufacturing processes to a minimum. The housing is made from a low carbon steel on a progressive die and requires as a maximum a single machining step to form the flux plate seat 90 and metering plate seat 96. As previously noted, the former machining step can be eliminated by the dimpled configuration of FIG. 11. The flux plate is a simple steel samping pressed into the housing while the end plate could be either a sintered casting or cold formed low carbon steel. The bobbin and bobbin cover are molded plastic parts. The only machined parts are the valve stem 110, armature 116, stator 124 and stationary valve member 102. The conical valve seat 106 of the stationary valve member 102 is a simple conical shape.

Having disclosed the unitized fuel injection system, it is submitted the invention is not limited to the specific embodiments shown on the FIGURES and discussed in the Specification. It is recognized that a person skilled in the art is capable of making changes to the unitized fuel injection system without departing from the invention as set forth in the appended claims.

I claim:

1. A unitized fuel injection system comprising:

a unitized fuel rail having a tubular rail member having an input at one end for receiving fuel under pressure and a plurality of output apertures disposed at predetermined positions along its length, a fuel pressure regulator permanently attached to the opposite end of said rail member for controlling the pressure of the fuel in the rail member, and a plurality of cylindrical valve housings, one of said valve housings permanently attached to said rail member coincident with each of said outlet apertures; each of said valve housings having a forward necked down section, an annular end face partially enclosing the end of said necked down section, a body section attached directly to said rail member, and an intermediate section interconnecting said necked down section with said body section, each of said body sections having a fuel inlet aperture mating with said outlet aperture interconnecting the interior of said valve housing with the interior of said rail member;

a metering plate disposed in each of said valve housings abutting said annular end face, said metering plate haaving an axially disposed metering orifice;

a stationary valve member pressed into the necked down section of each valve housing and captivating said metering plate against said annular end face, each of said stationary valve members having an axial aperture intercepting said metering orifice at its forward end and terminating in a conical valve seat;

a light weight movable valve assembly concentrically disposed in each of said valve housings, each of said movable valve assemblies comprising a magnetically susceptible armature and a coaxial valve stem having one end attached to said armature and an opposite end having a spherical surface engaging said conical valve seat;

a magnetically susceptible end cap enclosing the rear end of each valve housing, each of said end caps having a central aperture and at least one terminal aperture;

a magnetically susceptible cylindrical stator concentrically disposed in each of said valve housings, one end of said stator received in the central aperture of said end cap and structurally supported therefrom, the other end of said stator separated from said armature by a predetermined distance; and a resilient member disposed in each valve housing between said stator and said armature urging the spherical surface of the valve stem into engagement with said conical valve seat with a predetermined force;

a cylindrical coil assembly disposed in each of said valve housings circumscribing said armature and said stator, each of said coil assemblies including a bobbin having a pair of electrically conductive terminals protruding external to said valve housing through said at least one terminal aperture of said end cap, a radial fluid vent connecting the entrapped space between said bobbin, said armature and said stator with the space between said bobbin and said housing, and a solenoid coil wound on said bobbin having one of its ends connected to one of said pair of electrical terminals and the other end connected to the other of said pair of electrical terminals.

2. The utilized fuel injection system of claim 1 wherein said valve housings are made from low carbon steel.

3. The unitized fuel injection system of claim 2 wherein said valve housings are progressive die formed valve housings.

4. The unitized fuel injector system of claim 3 wherein said resilient member is a spring and said stator has a shoulder engaging one end of said spring, said unitized fuel injector system further including a thin non-magnetic spring seat member disposed between said armature and said stator engaging the opposite end of said spring, the force of said spring holding said spring seat member against an end face said armature.

5. The unitized fuel injector system of claim 4 wherein said spring and the position of said stator's shoulder are matched at assembly so that said spring produces a predetermined force urging the spherical end of said stem valve against said conical valve seat.

6. The unitized fuel injector of claims 3 or 4 wherein said predetermined distance between said stator and said armature is sufficient to allow the spherial surface of said valve stem to be retracted from said conical valve seat a distance causing the fuel flow rate through said metering aperture to be virtually independent of the position of said valve stem.

7. The unitized fuel injector system of claim 6 wherein said distance said valve stem is retracted from said valve seat is 0.20 millimeters.

8. The unitized fuel injector system of claim 1 wherein said tubular rail member is a "U" shaped member having a pair of substantially parallel legs wherein said fuel pressure regulator is disposed at the end of one of said pair of legs and said plurality of valve housings are disposed along the other leg of said pair of legs.

9. A fuel injector valve comprising:

a magnetically permeable low carbon steel cylindrical housing having a forward necked down section partially enclosed by an annular end face, a body section having a radially disposed input aperture, and an intermediate section interconnecting said necked down section and said body section;

a stationary valve means having a metering orifice, a conical valve seat and an axial aperture concentric with said metering orifice fixedly disposed in said necked down section, adjacent to said annular end face;

a movable valve member concentrically disposed in said housing, said movable valve member having a lightweight magnetically susceptible armature and a small diameter valve stem concentric with the axis of said cylindrical housing, one end of said valve stem connected to said armature and the other end of said valve stem having a spherical end face engaging said valve seat;

a magnetically susceptible flux plate fixedly disposed in said housing, said flux plate having an axially disposed aperture circumscribing said armature;

a non-magnetic eyelet disposed in said axially disposed aperture to slidably support said armature in said housing;

an end cap enclosing the rear end of said housing having a central aperture and at least one electrical terminal aperture;

a stator concentrically disposed in said housing having a forward end separated from said armature by a predetermined distance, an intermediate shoulder and a rear end received in the central aperture of said end cap and attached thereto;

a non-magnetic spacer forming a spring seat disposed between said armature and said stator;

a spring disposed between said stator and said non-magnetic spacer, one end of said spring engaging said intermediate shoulder and the other end engaging said spring seat to bias said non-magentic spacer into engagement with said armature and said valve stem into engagement with said valve seat; and a cylindrical coil assembly disposed in said housing between said flux plate and said end cap and circumscribing said stator and a portion of said armature, said coil assembly including a solenoid coil, a bobbin having a pair of electrical terminals protruding external to said housing through said at least one electric terminal aperture in said end cap and a fluid vent connecting the entrapped volume between said stator, said armature and said bobbin with the space between said housing and said bobbin.

10. The improved fuel injector valve of claim 9 wherein said stationary valve means comprises:

a stationary valve member having said axial aperture and said conical valve seat; and a metering plate disposed between said stationary valve member and said annular end face having said metering orifice.

11. The improved fuel injector of claim 9 wherein said conical valve seat is provided at the bottom of a recess passing part way through said stationary valve member coaxial with said axial aperture.

12. The fuel injector valve of claim 9 wherein said spring and the position of said stator's shoulder are matched so that said spring produces a predetermined force urging the end face of said valve against said conical valve seat.

13. The fuel injector valve of claim 12 wherein the end face of said valve stem is a spherical segment.

14. The fuel injector valve of claim 9 wherein said predetermined distance separating said armature and said stator is sufficient to allow the end face of said valve stem to be retracted from said conical valve seat a distance so that the fuel flow rate through said metering orifice is substantially independent of the position of the valve stem.

15. The fuel injector valve of claim 14 wherein said distance said valve stem is retracted from said valve seat is approximately 0.20 millimeters.

16. The fuel injector valve of claim 9 further including a tubular rail member and wherein the housing of said fuel injector valve is permanently attached to said tubular rail member.

17. The fuel injector valve of claim 16 wherein said tubular rail member has a plurality of said housings permanently attached thereto.

18. The fuel injector valve of claims 16 or 17 further including a fuel pressure regulator permanently attached to one end of said rail member.

19. The fuel injector valve of claim 9 wherein said bobbin is a molded plastic bobbin.

20. The fuel injector valve of claim 19 wherein said bobbin includes a cover member enclosing said solenoid coil on said bobbin.

21. A fuel injection system comprising a fuel rail, a fuel pressure regulator connected to one end of the fuel rail and a plurality of fuel injector valves connected to the fuel rail at predetermined positions there along, wherein each fuel injector valve comprises a generally cylindrical valve housing, a metering orifice, a stationary valve member having a conical valve seat disposed at one end of the housing, a movable valve member having an axial valve stem attached to an axially movable armature, a coaxial stator attached to an end cap axially separated from said armature by a predetermined distance, a resilient member disposed between said armature and stator to produce a force urging the valve stem against said valve seat, and a coil assembly circumscribing said armature and stator for producing a magnetic force moving said armature against the force of the resilient member towards said stator and unseating said valve stem from said valve seat permitting fuel to flow through said metering aperture characterized in that:

each of said housings are tangentially and permanently attached to said fuel rail and becoming an integral part thereof, each valve housings having a fuel input port interfacing with a mating port in the fuel rail at the point of tangential attachment;

each of said stators axially separated from said armatures a distance sufficient so that when said valve stem is fully retracted from said valve seat the fuel flow is primarily dependent upon the diameter of said metering orifice and independent of the position of the valve stem; and each of said coil assemblies has a radial relief vent connecting a volume enclosed between said armature, stator and coil assembly with the remainder of the volume enclosed by the housing permitting a fuel flow therebetween with the reciprocating movement of said movable valve member.

22. The fuel injector system of claim 21 wherein said fluid pressure regulator is permanently attached to one end of said fuel rail and is an integral part thereof.

23. The fuel injector system of claims 21 or 22 wherein said valve housing is a progressive die formed valve housing.

24. The fuel injector system of claim 23 further including a non-magnetic spacer between said armature and stator.

25. The fuel injector system of claim 24 wherein said spacer is attached to said stator.

26. The fuel injector system of claim 25 wherein said predetermined distance between said armature and stator is sufficient to permit said valve stem to be disposed from said conical valve seat approximately 0.20 millimeters.

27. The fuel injector system of claim 24 wherein said resilient member is a spring and said stator has a shoulder engaged by one end of said spring, said spacer is a cup shaped member having a peripheral flange engaged by the opposite end of said spring.

28. The fuel injector system of claim 27 wherein said return spring and the position of said stator's shoulder are preselected at assembly so that said return spring produces a predetermined force urging the spherical end of said valve stem against said valve seat.

29. The fuel injector of claim 24 wherein said resilient member is a return spring and said stator has a shoulder engaged by one end of said return spring, said return spring and the position of said stator's shoulder are preselected at assembly so that said return spring produces a predetermined force uring the spherical end of said valve stem against said valve seat.

30. The fuel injector system of claim 21 wherein said predetermined distance between said armature and stator is sufficient to permit said valve stem to be displaced from said conical valve seat approximately 0.20 millimeters.

31. The fuel injector system of claim 21 wherein said stator is permanently attached to said end cap and supported therefrom coaxial with said armature.

* * * * *